US012344986B2

(12) United States Patent
Leibman et al.

(10) Patent No.: US 12,344,986 B2
(45) Date of Patent: Jul. 1, 2025

(54) IMPELLER AND PUMP FOR COMBINATION WASHER AND DRYER LAUNDRY APPLIANCE

(71) Applicant: Haier US Appliance Solutions, Inc., Wilmington, DE (US)

(72) Inventors: Alexander B. Leibman, Prospect, KY (US); Hannah Suter, Shelbyville, KY (US); Venkata Chakradhar Rangu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 317 days.

(21) Appl. No.: 18/093,404

(22) Filed: Jan. 5, 2023

(65) Prior Publication Data

US 2024/0229336 A1 Jul. 11, 2024

(51) Int. Cl.

| | |
|---|---|
| ***D06F 39/08*** | (2006.01) |
| ***D06F 25/00*** | (2006.01) |
| ***F04D 1/00*** | (2006.01) |
| ***F04D 29/24*** | (2006.01) |

(52) U.S. Cl.

CPC ..... *D06F 39/085* (2013.01); *D06F 25/00* (2013.01); *F04D 1/00* (2013.01); *F04D 29/24* (2013.01)

(58) Field of Classification Search

CPC ..... D06F 39/085; F04D 1/00; F04D 29/24

See application file for complete search history.

(56) References Cited

U.S. PATENT DOCUMENTS

| | | | | |
|---|---|---|---|---|
| 3,949,438 | A | 4/1976 | Scales | |
| 4,201,200 | A | 5/1980 | Hubner | |
| 4,852,621 | A | 8/1989 | Bear | |
| 5,031,255 | A | 7/1991 | Hilger et al. | |
| 6,602,058 | B1 | 8/2003 | Stewart | |
| 8,297,949 | B1 | 10/2012 | Mancl et al. | |
| 8,465,597 | B2 | 6/2013 | Turner | |
| 8,766,580 | B2 | 7/2014 | Marioni | |
| 9,441,874 | B2 | 9/2016 | Bird et al. | |
| 9,455,572 | B2 | 9/2016 | Motsenbocker | |
| 9,746,238 | B2 | 8/2017 | Lim et al. | |
| 10,082,303 | B2 | 9/2018 | Choi et al. | |
| 10,451,320 | B2 | 10/2019 | Benedict et al. | |
| 10,718,081 | B2 | 7/2020 | Choi et al. | |
| 11,122,959 | B2 | 9/2021 | Kopera et al. | |
| 11,142,863 | B2 | 10/2021 | Dunn et al. | |
| 2010/0080694 | A1* | 4/2010 | Chapman | F04D 29/462 415/160 |
| 2013/0074554 | A1 | 3/2013 | Chun et al. | |
| 2015/0191863 | A1* | 7/2015 | Kim | D06F 58/20 34/493 |
| 2016/0289881 | A1 | 10/2016 | Song et al. | |

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A discharge pump and a horizontal axis combination washer and dryer employing the discharge pump is provided. The discharge pump includes an impeller with a first portion having a plurality of closed vanes and a second portion having a plurality of open vanes, the impeller received within a shroud. In the horizontal axis combination washer and dryer, the discharge pump selectively discharges wash water to a drain and drying air to a vent.

19 Claims, 7 Drawing Sheets

IMPELLER AND PUMP FOR COMBINATION WASHER AND DRYER LAUNDRY APPLIANCE

FIELD OF THE INVENTION

The present disclosure relates generally to a pump to remove water during a wash cycle and to remove air during a dry cycle for a combination washer dryer laundry appliance.

BACKGROUND OF THE INVENTION

Combination washer and dryer appliances have become increasingly popular in recent years. In particular, combination washer and dryer appliances are often attractive because of the utility and space savings of having one appliance performing the functions of two similarly sized appliances.

In fulfilling the requirements of a washer and a dryer, many conventional combination units duplicate the water handling equipment and air handling equipment of a dedicated washer and a dedicated dryer. Duplicate water handling and air handling systems often includes one electric motor to drive the water pump for the washing machine function and an electric motor to power a blower for the dryer function. Issues may arise with duplicating systems including a crowded appliance cabinet making repairs difficult, increased weight of the machine, and increased manufacturing costs.

Accordingly, it may be beneficial to combine air handling and water handling equipment in a combination washer and dryer laundry appliance. In particular, advantages may be achieved in providing one pump driven by one motor to move both the washing liquid and the drying air through the combination laundry appliance.

BRIEF DESCRIPTION OF THE INVENTION

Aspects and advantages of the invention will be set forth in part in the following description, may be apparent from the description, or may be learned through practice of the invention.

In one exemplary aspect, an impeller for a discharge pump is disclosed. The impeller comprises a first portion having a lower disk with a top surface, an upper disk spaced from the lower disk, the upper disk having a top surface, a bottom surface, and defining an axial passage. A plurality of closed vanes extends from the top surface of the lower disk to the bottom surface of the upper disk. A second portion comprises a plurality of open vanes supported on the top surface of the upper disk.

In another example aspect, a discharge pump comprising a top shroud, a bottom shroud and an impeller is disclosed. The impeller comprises a first portion having a lower disk with a top surface, an upper disk spaced from the lower disk, the upper disk having a top surface, a bottom surface, and defining an axial passage. A plurality of closed vanes extends from the top surface of the lower disk to the bottom surface of the upper disk. A second portion comprises a plurality of open vanes supported on the top surface of the upper disk. A portion of the top shroud engages a portion of the bottom shroud to form a shroud assembly adapted to receive the impeller.

In another example a horizontal axis combination washer and dryer laundry appliance is disclosed. The laundry appliance comprises a cabinet having a front panel defining an opening, a tub mounted within the cabinet, and a laundry basket mounted within the tub. A water supply is provided to supply water to the tub and an air intake is provided to supply ambient air to the tub. A discharge pump is fluidly coupled to the tub, the discharge pump selectively discharges water to a drain in a wash cycle and the ambient air to a vent during a dryer cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
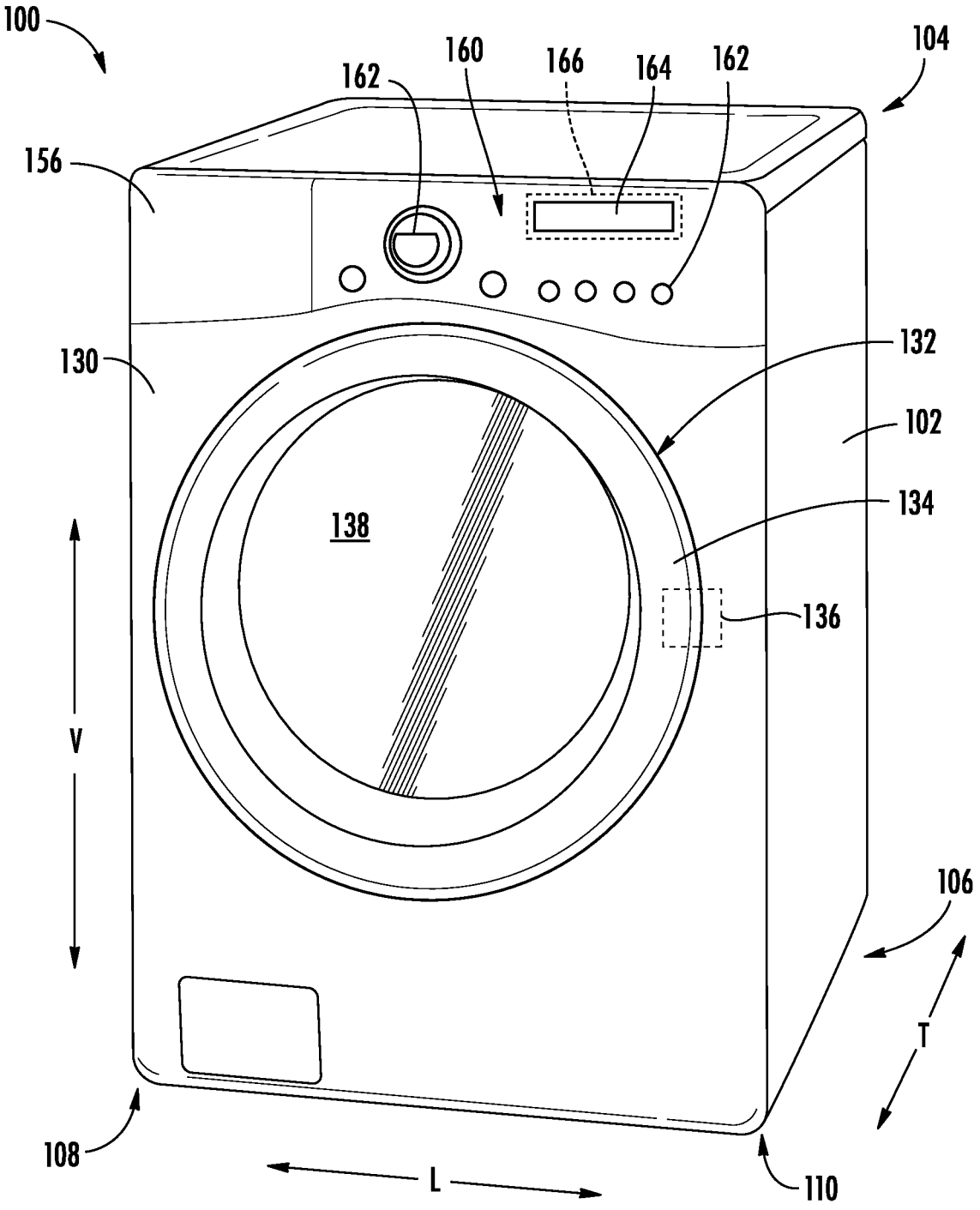
FIG. 1 provides a perspective view of a laundry appliance in accordance with an embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the figures, an exemplary combination washer and dryer laundry appliance that may be used to implement aspects of the present subject matter will be described. Specifically, FIG. 1 is a perspective view of an exemplary horizontal axis washer and dryer combination appliance 100, referred to herein for simplicity as laundry appliance 100.

Figure 2:
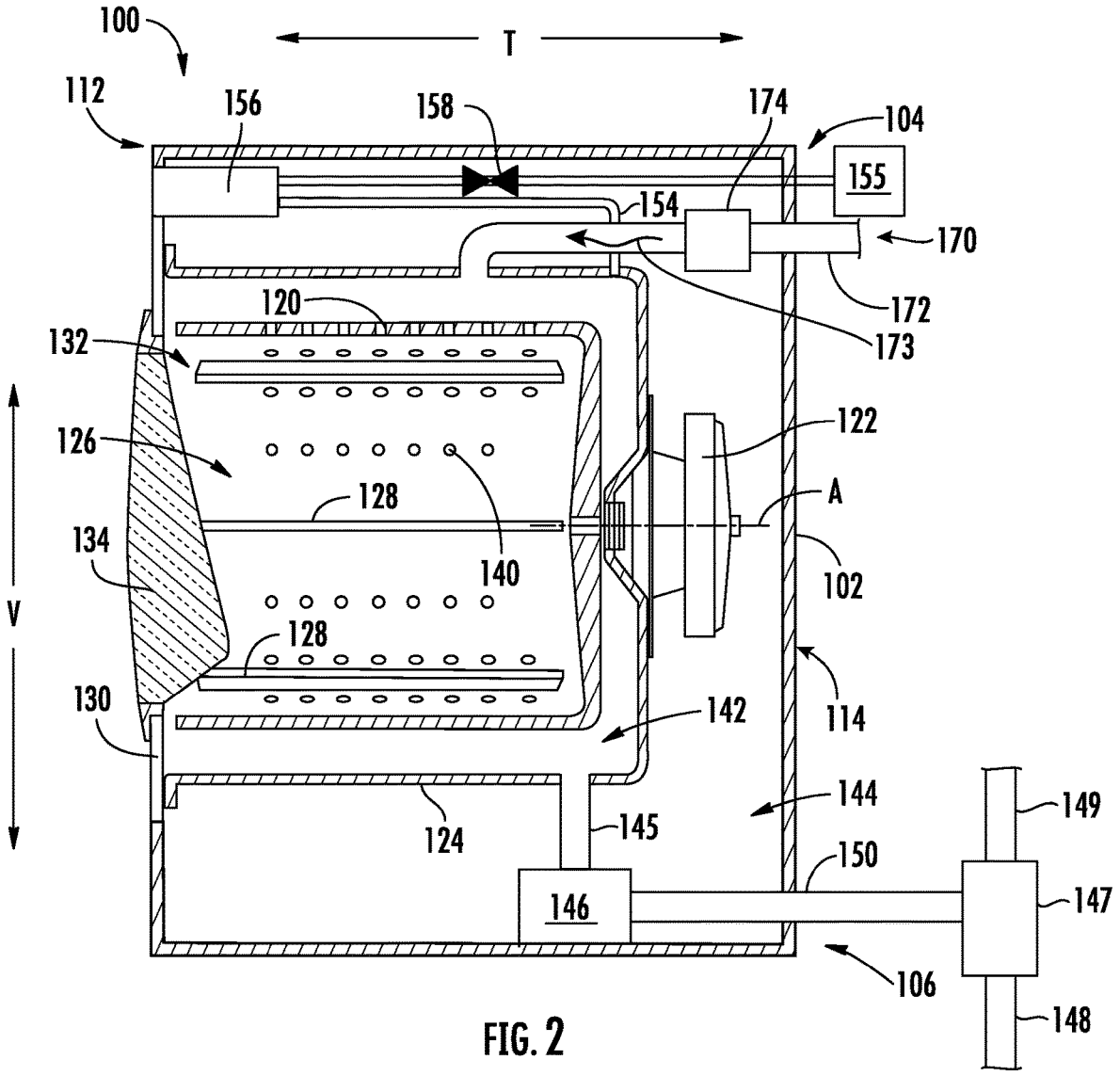
FIG. 2 provides a side cross-sectional view of the exemplary laundry appliance of FIG. 1.

FIG. 2 is a side cross-sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted and supported within cabinet 102 such that it is rotatable about an axis of rotation A. According to the illustrated embodiment, axis of rotation A is substantially parallel to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle of laundry appliance 100). Motor 220 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further a latch assembly 136 (see FIG. 1) that is mounted to cabinet 102 or door 134 for selectively locking door 134 in the closed position. Latch assembly 136 may be desirable, for example, to ensure only secured access to chamber 126 or to otherwise ensure and verify that door 134 is closed during certain operating cycles or events.

A window 138 in door 134 permits viewing of laundry basket 120 when door 134 is in the closed position, e.g., during operation of laundry appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. In some embodiments, tub 124 is inclined from the horizontal such that the rear portion (adjacent to rear 114) of the tub 124 is lower that the front portion (adjacent to front 112). In some cases, the incline can be 15 degrees or approximately 15 degrees. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain assembly 144 is located beneath tub 124 and is in fluid communication with sump 142 for periodically removing soiled wash fluid or rinse fluid from laundry appliance 100. Drain assembly 144 may generally include a discharge pump 146 (to be discussed more fully below) which is in fluid communication with sump 142 through tub drain hose 145. Discharge pump 146 is also in fluid communication with external drain 148 through a diverter 147 and drain hose 150. During a drain cycle, discharge pump 146 urges a flow of wash fluid or rinse fluid from sump 142, through drain hose 150 and diverter 147 to external drain 148. In an embodiment, the diverter may be a fitting with three ends, two aligned on a common centerline and one with an end on a centerline generally perpendicular to the first, commonly referred to as a Tee fitting. The perpendicular end may be coupled to the drain hose and the centerline of the two other ends arranged vertically. The downward directed end would accept a flow of wash or rinse fluid and direct it to a waste, such as a sanitary sewer. The upward directed end would direct a flow of air and water vapor to a vent. In some embodiments, the air and water vapor may be directed to a apparatus to remove the water vapor from the air and return the air to the air intake 172. The water vapor removed from the air and condensed to a liquid may be directed to a waste, such as a sanitary sewer.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, as spout 154 directs a portion of fluid flow into the tub 124, the portion may flow into laundry basket 120 through perforations 140 at the vertical top of the laundry basket and out of the laundry basket 124 through perforations 140 at the vertical bottom of the laundry basket 124 and into the sump 142. Another portion of the fluid flow from the spout 154 may flow around the laundry basket 120 and directly into the sump 142.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In addition, a water supply valve or control valve 158 may provide a flow of water from a water supply source (such as a municipal water supply 155) into detergent dispenser 156 or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of laundry appliance 100 is controlled by a controller 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, or other fluid additives, e.g., via spout 154 and or detergent drawer 156. One or more valves (e.g., control valve 158) can be controlled by laundry appliance 100 to provide for filling laundry basket 120 to the appropriate level for the articles being washed or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, or rinsed, the combination laundry appliance 100 can initiate a drying cycle.

In the drying cycle, laundry articles, still containing some water from the washing operation (i.e., damp laundry articles), may be tumbled in the basket 120 by the rotating action of the motor 220. Ribs 128 may help lift and tumble the laundry articles to facilitate the drying operation by causing excess moisture to be liberated from the laundry articles as water vapor. While tumbling, ambient air 170 is drawn into the basket 120 through air intake 172 through the action of discharge pump 146. Discharge pump 146 creates a negative pressure in the chamber 126 urging the water vapor (i.e., humid air) out of the chamber 126.

Air intake 172 is in fluid communication with tub 124 and chamber 126 via perforations 140 in the basket 120. The ambient air 170 passing through the chamber containing the damp laundry articles as they are being tumbled, further facilitating the drying of the articles by removing additional water from the damp laundry articles as well as removing the water vapor liberated due to tumbling.

In some embodiments, ambient air 170 may pass through a heater element 174 to introduce heated air 173 to the tub 124. Heated air 173 may facilitate more rapid or thorough removal of water from the damp laundry articles. Heater 174 may be any type of heater element suitable for heating an air flow to a temperature sufficient to facilitate drying without damaging the laundry articles. For example, the heater element 174 may be configured to heat the ambient air to between 100° F. and 140° F. (38° C. and 60° C.).

Discharge pump 146 is adapted to discharge wash fluid from the tub 124 to an external drain 148 during the washing cycle and air from the tub 124 to a vent 149 during the drying cycle. Discharge pump 146 draws wash fluid and air, as appropriate for a washing cycle and a drying cycle, from the tub 124 and directs the fluids to the diverter 147. At diverter 147 wash fluid is discharged through external drain 148 to, for instance, a sanitary sewer or septic system. Also at diverter 147, ambient air, or heated ambient air, drawn through the tub 124 is discharged through vent 149 to the atmosphere during a drying cycle. Diverter 147 may be any suitable device capable of allowing the flow of a liquid (e.g., wash or rinse fluid) to a drain and air, with included water vapor, to flow to a vent.

Figure 3:
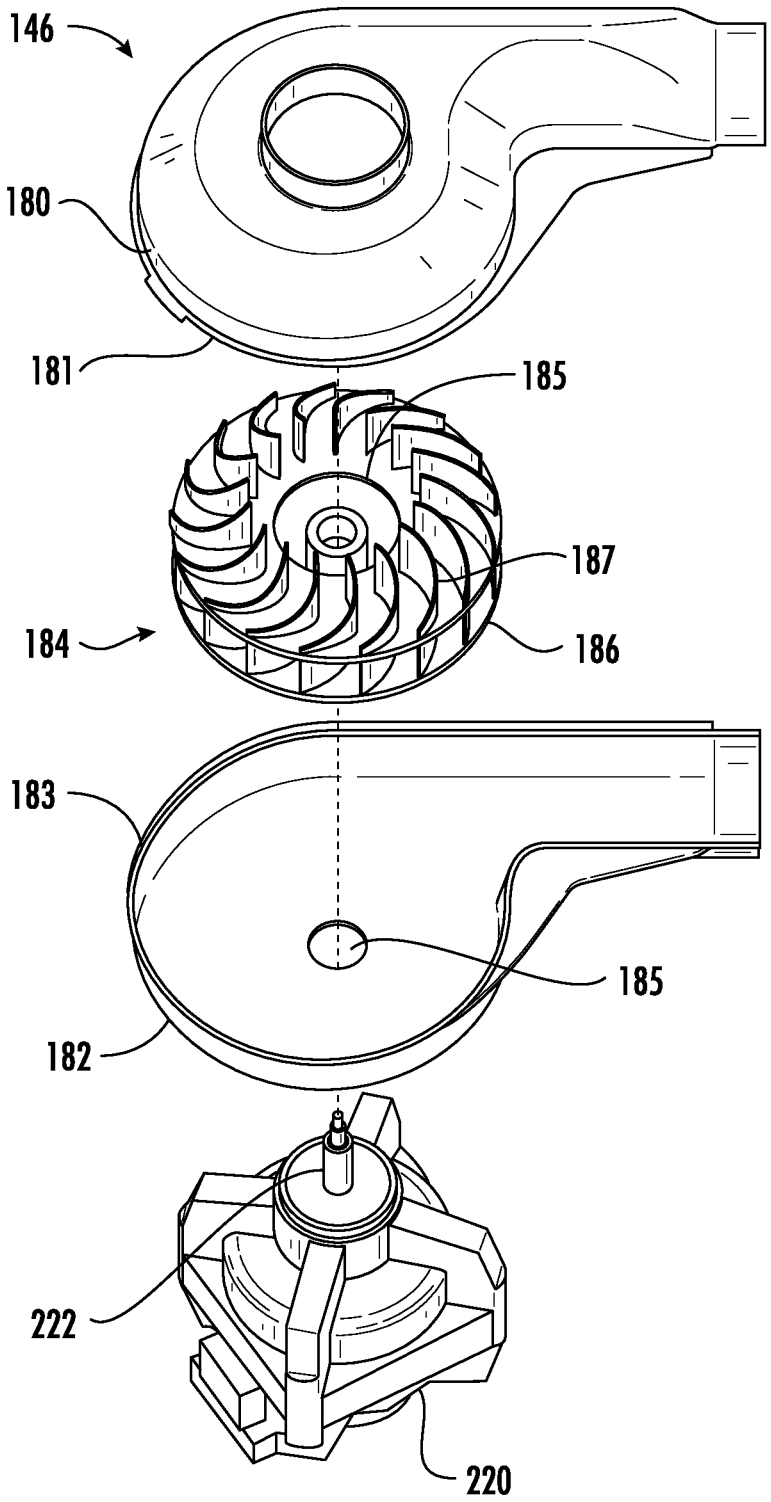
FIG. 3 provides an exploded view of a discharge pump assembly in accordance with an embodiment of the present disclosure.
Figure 4:
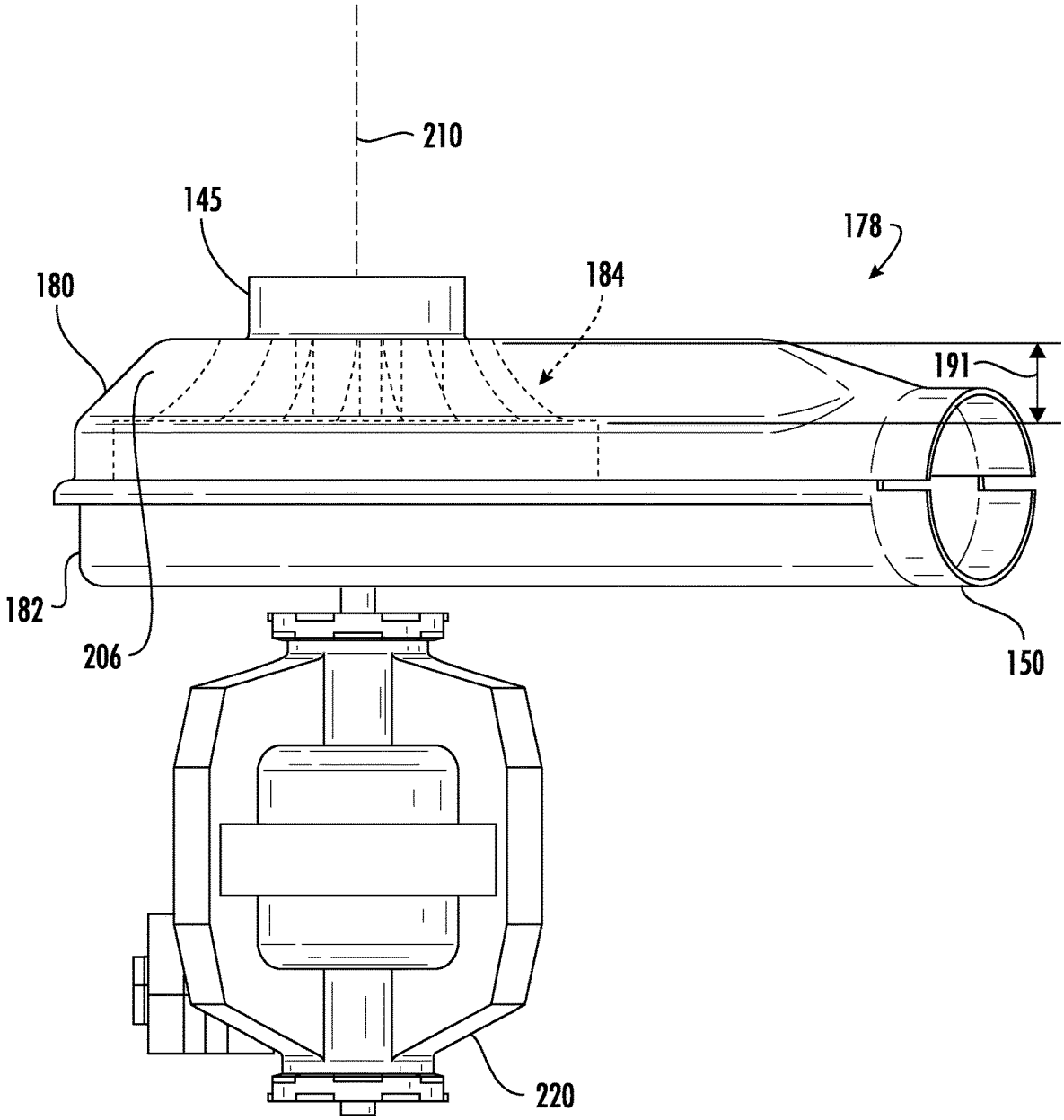
FIG. 4 provides an assembled view of the discharge pump of FIG. 3.
Figure 5:
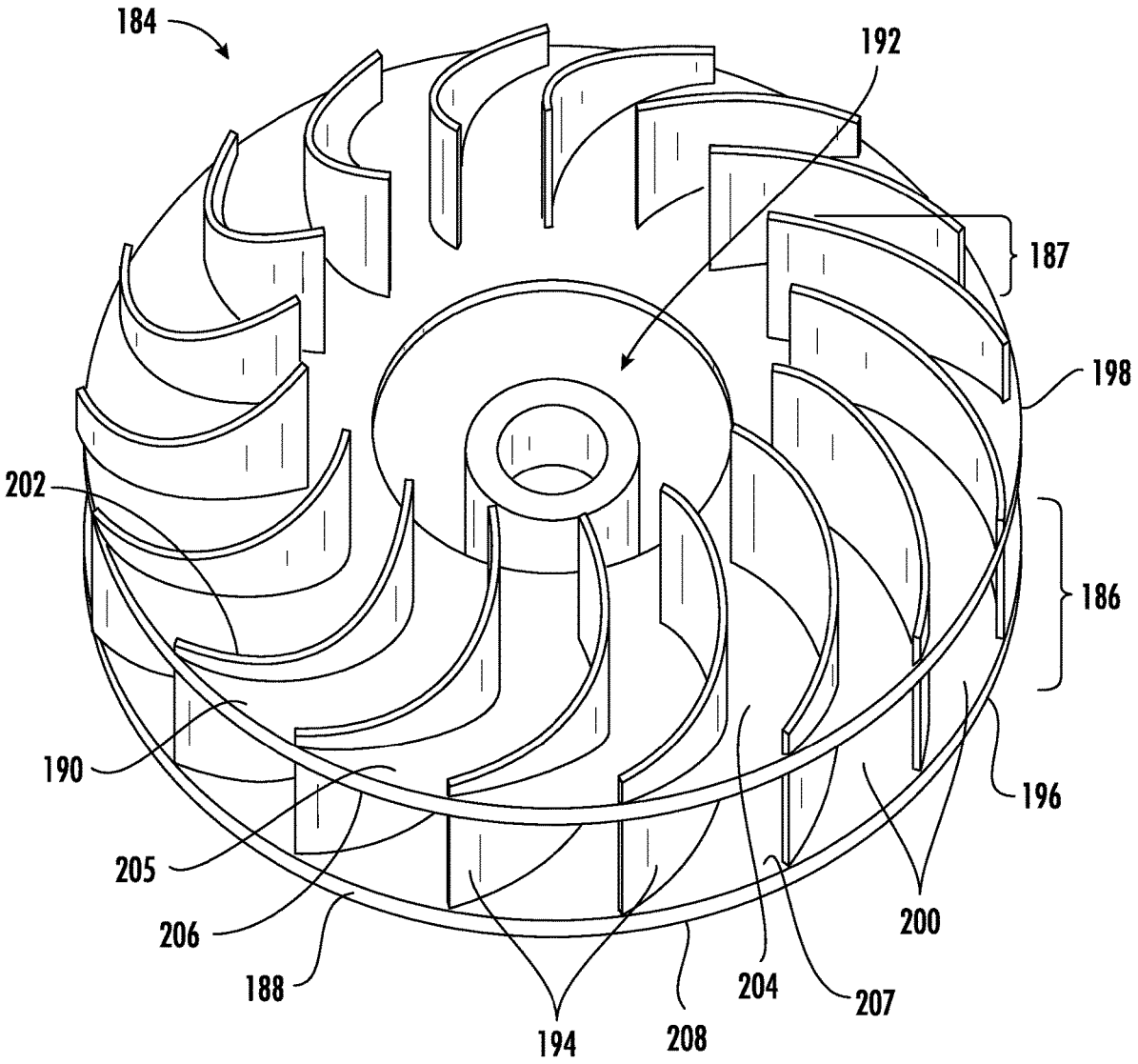
FIG. 5 provides an enlarged view of an impeller in accordance with an embodiment of the present disclosure.
Figure 6:
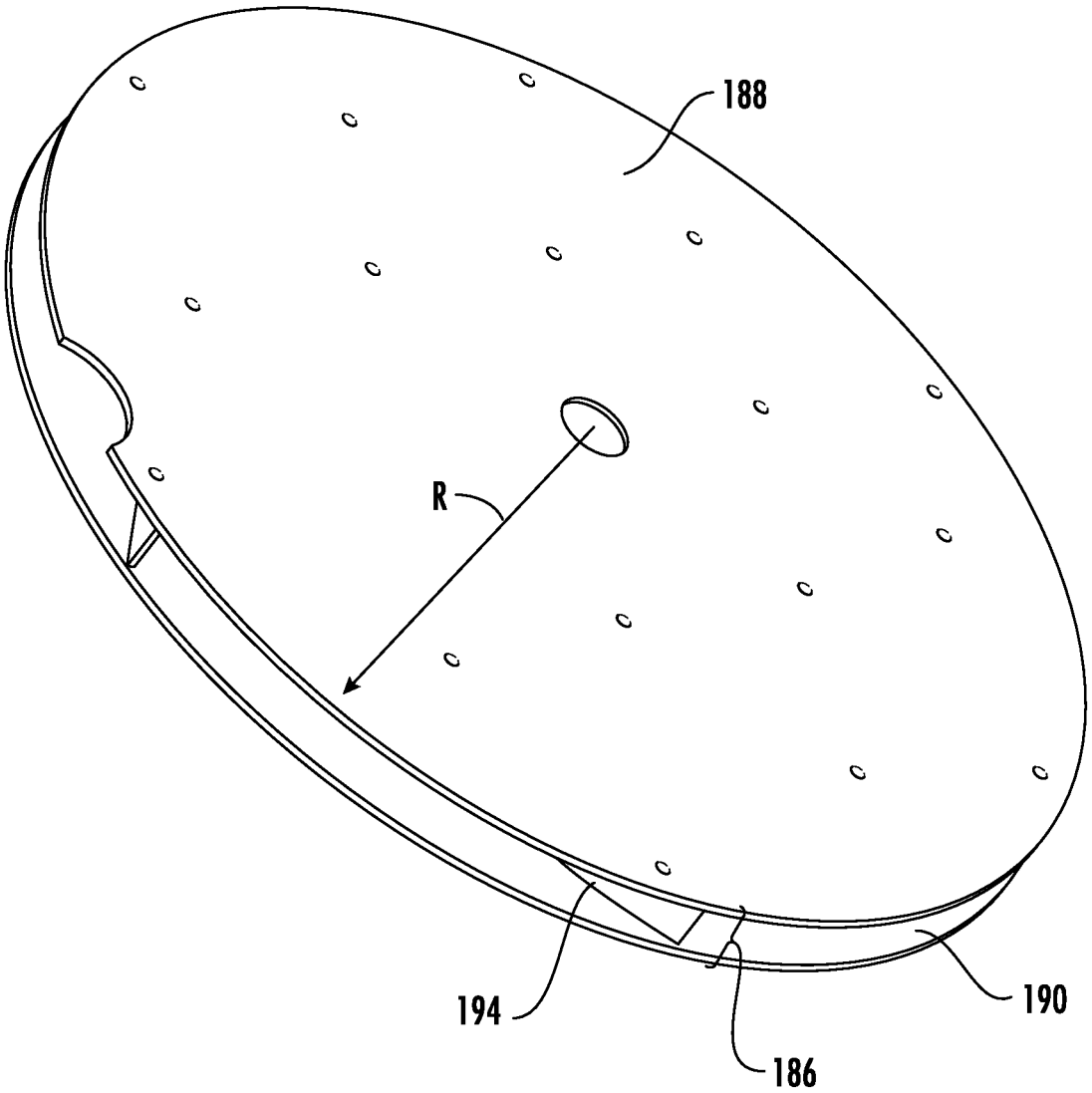
FIG. 6 represents a bottom view of the impeller of FIG. 5.
Figure 7:
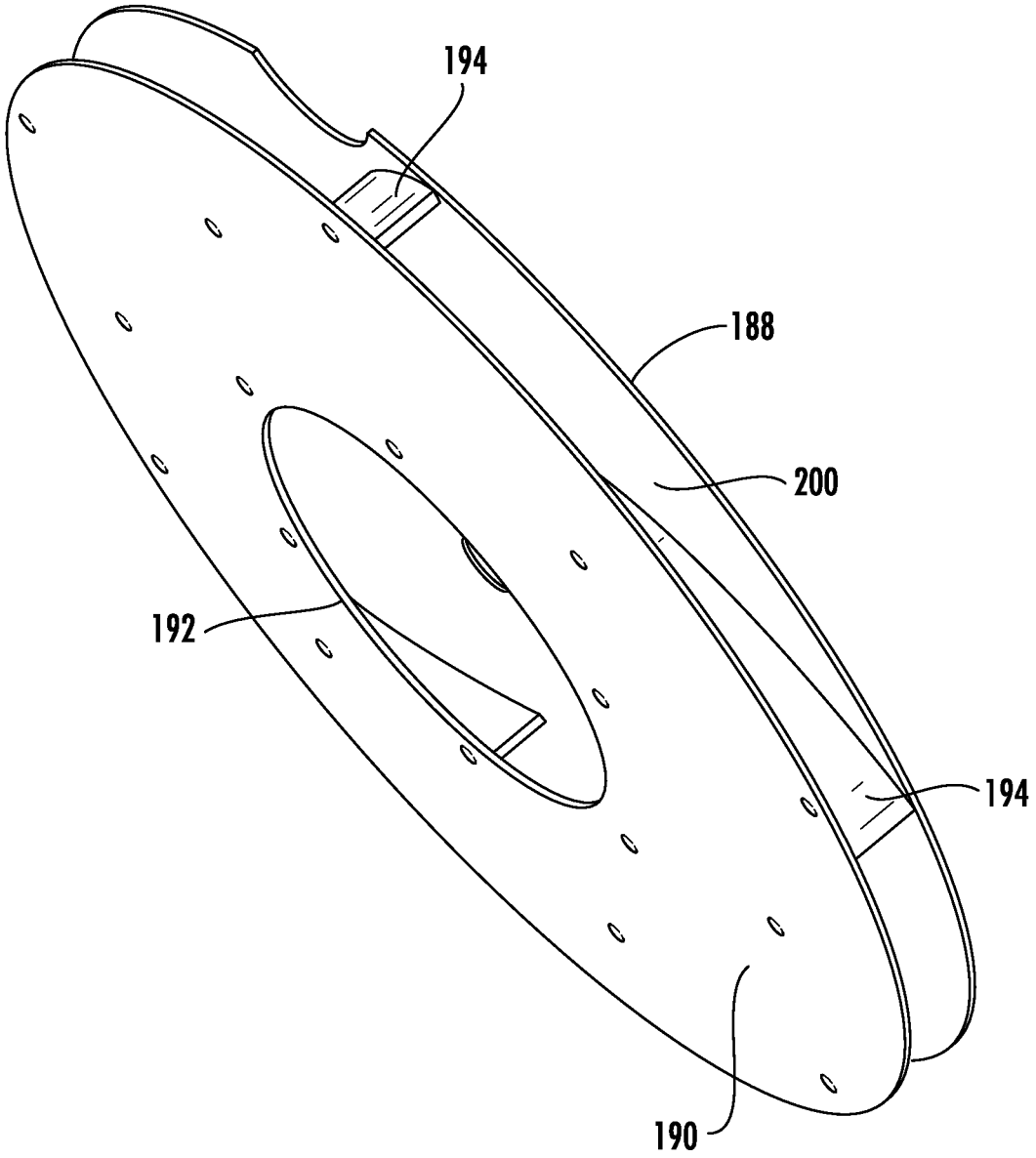
FIG. 7 represents a view of a portion of the impeller of FIG. 5.

Discharge pump 146, shown schematically in FIG. 2, is illustrated with more specificity in FIGS. 3 and 4 in which the discharge pump assembly is shown in an exploded view (FIG. 3) and as an assembly in FIG. 4. FIG. 5 is an enlarged view of the impeller 184 of FIGS. 3 and 4. FIG. 6 represents a bottom view of the impeller of FIG. 5 and FIG. 7 represents a portion of the impeller of FIG. 5.

In the exemplary embodiment of FIGS. 3 and 4, discharge pump 146 comprises top shroud 180, bottom shroud 182, and impeller 184. Top shroud 180 includes a circular portion 181 configured to engage circular portion 183 of bottom shroud 182 to form a shroud assembly 178. When assembled as shroud assembly 178 as in FIG. 4, top and bottom shroud 180, 182 are sealed in a water-tight fashion and may include a gasket (not shown) to achieve a sufficient seal. Additional gasketing may also be required to achieve a sufficient seal.

At least circular portions 181, 183 of top shroud 180 and bottom shroud 182 are adapted to receive impeller 184. Impeller 184 may be concentrically located within the circular portions 181, 183 for free rotation within the shroud assembly 178.

Exemplary impeller 184 as illustrated comprises a first portion 186 comprising lower disk 188 and upper disk 190. Lower and upper disks 188, 190 are concentric disks spaced apart from, and parallel to, each other. Lower disk includes a top surface 207 and an opposing surface, bottom surface 208. Upper disk 190 includes a top surface 205 and an opposing bottom surface 206. Upper disk 190 defines a circular axial passage 192 (i.e., parallel to axis 210, FIG. 4) into the space between the two disks 188, 190, with passage 192 coaxial with upper disk 190. Passage 192 is sometimes referred to as the suction eye of a closed impeller.

A plurality of closed radial vanes 194 span the space between lower and upper disks 188, 190. As shown, closed radial vanes extend between surface 206 of upper disk 190 and surface 207 of lower disk 188 and are affixed to, or formed with, each surface. Closed vanes 194 may be perpendicular to lower and upper disks 188, 190. In some embodiments, closed vanes 194 may be arcuate in shape between upper disks 188, 190 (and surfaces 206 and 207). According to some embodiments, closed vanes 194 may extend radially (i.e., generally in the direction R of FIG. 6) along a curved path from the outer perimeter 196 of lower disk 188 (which is radially coterminous with the outer perimeter 198 of upper disk 190) towards the center of lower disk 188. In some embodiments, closed vanes 194 terminate radially inward at passage 192, or approximately at passage 192. Closed vanes 194 are parallel to each other along their radial paths. Adjacent closed vanes 194 cooperate to form a tunnel 200 bounded by two adjacent vanes 194, lower disk 188, and upper disk 190. Specifically, the tunnel 200 is bounded by two adjacent vanes 194, the top surface 207 of lower disk 188, and the bottom surface 206 of the upper disk 190. As such, the tunnel 200 follows an arcuate path similar to that of the closed vanes 194 with the tunnel extending from the outer perimeters 196, 198 to the axial passage 192 and in fluid communication with the passage 192.

FIG. 7 is illustrative of the upper disk 190 of impeller 184. Closed vanes 194 extend from lower disk 188 to upper disk 190 and are supported at their axial ends (i.e., ends along the direction defined by axis 210) by the lower and upper disks 188, 190. Tunnel 200 is bounded by consecutive closed vanes 194 and by lower and upper disks 188, 190. The lower and upper disks 188, 190 bounding, or closing, the tunnels 200 give rise to the "closed vane" nomenclature.

Second portion 187 of exemplary impeller 184 is disposed on upper disk 190, specifically on surface 205, and comprises a plurality of semi-open vanes, open vanes 202, extending axially from the upper disk 190. Semi-open vanes are supported by one surface 205 of upper disk 190 and are affixed to, or formed with, upper disk 190. Open vanes 202 follow an arcuate path from the outer perimeter 198 of upper disk 190 towards to axial passage 192. In some embodiments, the open vanes 202 follow the same arcuate path as the closed vanes 194 and are directly vertically above the closed vanes 194 (i.e., the closed vanes 194 and the open vanes 202 are colinear or vertically aligned) and may be the same in number as the closed vanes 194. In other embodiments, the arcuate paths of open vanes 202 may differ from the arcuate path of closed vanes 194 and open vanes 202 may differ in number from closed vanes 194. Open vanes 202 are parallel to each other along their arcuate paths.

Second portion 187 includes open tunnels 204 formed between adjacent open vanes 202 and bounded on one side by upper disk 190. As may be seen in FIGS. 4 and 5, the open vanes 202 decrease in axial height 191 from the axial passage 192 to the outer perimeter 198 of upper disk 190. When assembled with the top and bottom shrouds 180, 182, top shroud cooperates with open vanes 202 to generally form a closed tunnel with an inside surface 206 of top shroud 180 forming an upper boundary to otherwise open tunnel 204.

When assembled in the top and bottom shrouds 180, 182, axial passage 192 aligns with (i.e., is coaxial with) tub drain hose 145. Thus, axial passage 192 is the fluid inlet portion, or suction eye, of the discharge pump 146. Top and bottom shrouds 180, 182 cooperate when assembled (FIG. 4) to form a portion of drain hose 150, the outlet side of discharge pump 146.

Discharge pump 146 includes motor 220, which may be any suitable electric motor to provide rotational torque to impeller 184. In the embodiment of FIGS. 3 and 4, motor 220 includes shaft 222 which is fixedly attached to impeller 184 to support the impeller 184 for rotation about axis 210.

As such, rotation of shaft 222 transfers rotation to the impeller 184. As illustrated, bottom shroud 182 defines a centrally located opening 185 to accept shaft 222 of motor 220. Opening 185 may include seals and gaskets (not shown) to provide a water-tight seal relationship between the bottom shroud 182 and the shaft 222. In other embodiments, motor 220 and impeller 184 are magnetically linked through the bottom shroud 182 such that no opening 190 is required through the bottom shroud 182 obviating the need for seals and gaskets.

Motor 220 is selectively energized by controller 166 to operate at desirable times during the washing and drying cycles. Controller 166 may regulate the speed of rotation of the motor 220 and the duration of operation as required to drain wash fluid from the tub 124 or generate a sufficient air flow through the tub during the drying cycle. In either operation (i.e., wash water removal or air flow generation), the discharge pump operates under the same principle. As discussed above, axial passage 192 is the fluid inlet portion of the discharge pump 146. Wash fluid or air enters the axial passage 192 through tub drain hose 145.

As illustrated for example in FIG. 2 and discussed above, wash water may flow by gravity to sump 142. Similarly, wash water may also flow by gravity to discharge pump 146 through tub drain hose 145, and specifically to axial passage 192 (i.e., suction eye) of discharge pump 146. Upon energizing the motor 220 to rotate shaft 222, open vanes 202 and closed vanes 194 cooperate with top shroud 180 and bottom shroud 182 to create a reduced pressure (i.e., suction) to draw fluid out of the tub 124.

During the drying cycle, when ambient air 172 or heated air 173, with moisture from the damp laundry articles, is the fluid to be discharged by discharge pump 146, closed vanes 194, or closed vanes 194 and open vanes 202, provide sufficient suction to draw ambient air 170 through air intake 172, through optional heater 174 if necessary, through laundry basket 120 and chamber 126, and exhaust the air through vent 149.

Shaft 222 and impeller 184 are coaxial with, and rotate about, axis 192. Rotation of the impeller 184 about axis 192 in the clockwise direction (when looking down the axis towards the motor 220) as imparted by rotation of shaft 222 of motor 220 creates centrifugal force on the fluid (wash fluid or air) in the axial passage 192 causing the fluid to move radially outward (i.e., in the radial direction R of FIG. 6) into tunnel 200 and open tunnel 204. The centrifugal force drives the fluid radially outward. The open tunnel 204 decreases in height due to the decrease in axial height 191 of the open vanes in the radially outward direction. As the height of the open tunnel 204 decreases, the volume decreases and the fluid becomes pressurized. Continued rotation of the impeller 184 draws more fluid into the tunnel 200 and open tunnel 204 and further pressurizes the fluid therein. Circular portion 183 of bottom shroud 182 and corresponding circular portion 181 of top shroud 180, when assembled as in FIG. 4, contain the fluid in the tunnel and open tunnel 200, 204 and prevent the fluid from flowing out radially. When the tunnel 200 and open tunnel 204 rotate about axis 192 such that they are aligned with drain hose 150, the fluid is no longer contained and is urged to flow out into drain hose 150. The pressurized fluid is urged to diverter 147 where liquid fluid (i.e., wash fluid) is directed to external drain 148 and gaseous fluid (i.e., ambient air 170 or heated air 173 plus water vapor) is directed to vent 149.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An impeller for a discharge pump, the impeller comprising:
- a first portion comprising:
  - a lower disk having a top surface;
  - an upper disk spaced apart from the lower disk, the upper disk having a top surface, a bottom surface, and an opening defining an axial passage;
  - a plurality of closed vanes extending from the top surface of the lower disk to the bottom surface of the upper disk; and a
  - a second portion comprising a plurality of open vanes supported on the top surface of the upper disk.

2. The impeller of claim 1, wherein the upper disk and the lower disk are concentric, parallel, and radially coterminous.

3. The impeller of claim 1, wherein the plurality of closed vanes extends radially from an outer perimeter towards a center of the lower disk.

4. The impeller of claim 1, wherein the plurality of closed vanes extends radially from an outer perimeter to the axial passage.

5. The impeller of claim 4, wherein adjacent closed vanes form a tunnel from an outer perimeter to the axial passage, the tunnel bounded by the adjacent closed vanes, the lower disk, and the upper disk.

6. The impeller of claim 1, wherein the plurality of closed vanes is perpendicular to the lower disk and the upper disk.

7. The impeller of claim 1, wherein the plurality of closed vanes is arcuate in shape between the lower disk and the upper disk.

8. The impeller of claim 1, wherein the plurality of open vanes extends axially from the upper disk.

9. The impeller of claim 8, wherein the plurality of open vanes extends radially from an outer perimeter to the axial passage.

10. The impeller of claim 9, wherein the plurality of open vanes decreases in axial height from the axial passage to the outer perimeter.

11. The impeller of claim 1, wherein the plurality of closed vanes and the plurality of open vanes extend radially from an outer perimeter to the axial passage.

12. The impeller of claim 11, wherein the plurality of closed vanes and the plurality of open vanes are equal in number.

13. The impeller of claim 12, wherein the plurality of closed vanes is colinear with the plurality of open vanes.

14. A discharge pump comprising:
- a top shroud;
- a bottom shroud; and
- an impeller, the impeller comprising:
  - a first portion comprising:
    - a lower disk having a top surface;
    - an upper disk spaced apart from the lower disk, the upper disk having a top surface, a bottom surface, and an opening defining an axial passage;
    - a plurality of closed vanes extending from the top surface of the lower disk to the bottom surface of the upper disk; and a second portion comprising a plurality of open vanes supported on the top surface of the upper disk, and wherein a portion of the top shroud engages a portion of the bottom shroud to form a shroud assembly, the shroud assembly adapted to receive the impeller.

15. The discharge pump of claim 14, wherein:

the plurality of closed vanes extends radially from an outer perimeter to the axial passage; and adjacent closed vanes form a tunnel from an outer perimeter to the opening defining the axial passage, the tunnel bounded by the adjacent closed vanes, the lower disk, and the upper disk.

16. The discharge pump of claim 14, wherein:

the plurality of open vanes extends axially from the upper disk and extend radially from an outer perimeter to the axial passage.

17. The discharge pump of claim 14, wherein:

the plurality of closed vanes and the plurality of open vanes are equal in number; and the plurality of closed vanes is colinear with the plurality of open vanes.

18. A horizontal axis combination washer and dryer laundry appliance comprising:

a cabinet having a front panel defining an opening;

a tub mounted within the cabinet;

a laundry basket mounted within the tub;

a water supply to supply water to the tub;

an air intake to supply ambient air to the tub; and a discharge pump fluidly coupled to the tub, the discharge pump comprising:

a top shroud;

a bottom shroud; and an impeller, the impeller comprising:

a first portion comprising:

a lower disk having a top surface;

an upper disk spaced apart from the lower disk, the upper disk having a top surface, a bottom surface, and an opening defining an axial passage;

a plurality of closed vanes extending from the top surface of the lower disk to the bottom surface of the upper disk; and a second portion comprising a plurality of open vanes supported on the top surface of the upper disk, wherein a portion of the top shroud engages a portion of the bottom shroud to form a shroud assembly, the shroud assembly adapted to receive the impeller, and wherein the discharge pump selectively discharges the water to a drain in a wash cycle and the ambient air to a vent during a dryer cycle.

19. The horizontal axis combination washer and dryer laundry appliance of claim 18, wherein:

the plurality of closed vanes extends radially from an outer perimeter to the axial passage: and the plurality of open vanes extends axially from the top surface of the upper disk and radially from an outer perimeter to the axial passage.

* * * * *